US007660673B2

(12) United States Patent
Dozier

(10) Patent No.: US 7,660,673 B2
(45) Date of Patent: Feb. 9, 2010

(54) COARSE WELLSITE ANALYSIS FOR FIELD DEVELOPMENT PLANNING

(75) Inventor: George C. Dozier, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/240,609

(22) Filed: Sep. 29, 2008

(65) Prior Publication Data

US 2009/0095469 A1 Apr. 16, 2009

Related U.S. Application Data

(60) Provisional application No. 60/979,578, filed on Oct. 12, 2007.

(51) Int. Cl.
*G01V 9/00* (2006.01)

(52) U.S. Cl. ..... 702/6; 73/38; 73/152.18; 175/50; 700/181; 700/185; 702/11; 702/179; 703/10

(58) Field of Classification Search ..... 702/6, 702/7, 9, 11, 12, 179, 181; 73/38, 152.18; 175/50; 700/281, 282–285; 703/10
See application file for complete search history.

(56) References Cited

U.S. PATENT DOCUMENTS

| | | | | |
|---|---|---|---|---|
| 7,003,439 | B2 * | 2/2006 | Aldred et al. | 703/10 |
| 7,577,527 | B2 * | 8/2009 | Vega Velasquez | 702/6 |
| 2008/0133194 | A1 * | 6/2008 | Klumpen et al. | 703/10 |

* cited by examiner

*Primary Examiner*—Eliseo Ramos Feliciano
*Assistant Examiner*—Elias Desta
(74) *Attorney, Agent, or Firm*—Yee & Associates, PC; Pramudji Wendt & Tran, LLP

(57) ABSTRACT

A new method for assessing the probability of production at a wellsite. The process includes the four steps of: 1) Data Collection and Uncertainty Analysis; 2) Wellsite Preparation; 3) Treatment Selection/Job Execution; and 4) Evaluation and Upscaling to Field Level.

20 Claims, 5 Drawing Sheets

COARSE WELLSITE ANALYSIS FOR FIELD DEVELOPMENT PLANNING

This patent application claims priority of U.S. Provisional Patent Application Ser. No. 60/979,578 filed Oct. 12, 2007.

BACKGROUND OF THE INVENTION

1. Field of the Invention

The present invention relates to methods and systems for use in oilfield data gathering. In particular, the invention provides a method, apparatus and system for assessing the probability of production at a wellsite.

2. Background of the Invention

In a typical exploration phase of potential wellsites, once a structure containing hydrocarbons is located, either through seismic or other techniques, a plurality of exploratory wells are drilled into the field. From those exploratory wells, a determination is made as to whether the field can be developed into an economically viable production field. That is, operating engineers determine whether enough production can be extracted from the field to overcome the huge capital expenditure necessary to develop the site. Quite simply, the question is asked, "is it profitable to develop the field?"

However, information that is gathered from the exploratory wells often does not provide adequate information for the operation engineer to make an informed decision. When telltale properties of the formation are "good," for example, the formation has a high porosity, a high saturation, a high natural flow profile, and a high permeability, a wealth of information can be obtained from just the exploratory wells, and well informed decisions regarding the economic development of the field can be made. For the most part, a lot of exploration is built around the assessment of these exploratory wells. If the formation has good permeability and flow characteristics, a few simple tests can be performed to determine information on the size and quantity of the site.

However, when telltale properties of the formation are not good, for example, the reservoir has low permeability or porosity, information gathered from exploratory wells may not realize any useful data. Even after spending millions in drilling the several exploratory wells, if the reservoir properties are not conducive to supplying good data, the data gathered from the exploratory wells may not provide adequate information to make an educated decision as to whether the site should be further developed. Operators are left knowing little more than before any of the exploratory wells had been conducted. Quite a few fields are therefore falsely labeled as dry, or not-economically viable, due to adequate information about the wellsite not being available.

SUMMARY OF THE INVENTION

In view of the above problems, an object of the present invention is to provide a method for assessing the probability of production at a wellsite within a field. The method comprises collecting data from an exploratory well and performing an uncertainty analysis on the data. The method comprises preparing the exploratory well for flow by performing at least one remedial measure on the wellbore of the exploratory well. The method comprises identifying an initial flow rate of hydrocarbons from a wellbore of the exploratory well. The method comprises performing a selected completion method on the exploratory well. The method comprises determining a second flow rate of hydrocarbons from the wellbore to identify an increased production amount due to the remedial measure. The method comprises responsive to identifying the increased production amount due to the remedial measure, evaluating results for the wellsite using a single well model. The method comprises upscaling the results to a field level.

A further object of the invention is to provide a method for assessing the probability of production at a wellsite within a field, wherein collecting data from an exploratory well, and performing an uncertainty analysis on the data further comprises identifying information from well logs, mud logs, and drilling flowback taken from the exploratory well. Collecting data from an exploratory well, and performing an uncertainty analysis on the data further comprises characterizing a near wellbore fracture network as either a single porosity zone or a dual porosity zone.

A further object of the invention is to provide a method for assessing the probability of production at a wellsite within a field, wherein characterizing the near wellbore fracture network further comprises seismically characterizing the near wellbore fracture network by identifying at least one of a seismic velocity, a seismic shear, and a seismic impedance.

A further object of the invention is to provide a method for assessing the probability of production at a wellsite within a field, wherein collecting data from an exploratory well, and performing an uncertainty analysis on the data further comprises developing the single well model to incorporate the data.

A further object of the invention is to provide a method for assessing the probability of production at a wellsite within a field, wherein the step of developing the single well model includes incorporating information from well logs, mud logs, and drilling flowback taken from the exploratory well, as well as measurements taken away from the wellbore. The step of developing the single well model further includes ignoring effects from wells within the field that are not effects from the exploratory well. The step of developing the single well model further includes developing a continuous wellbore model from the single well model, wherein the continuous wellbore model gives a point by point assessment of the parameters in the exploratory well such that various layers and potential reservoirs within the wellsite can be identified.

A further object of the invention is to provide a method for assessing the probability of production at a wellsite within a field, wherein the step of collecting data from an exploratory well, and performing an uncertainty analysis on the data further comprises performing an uncertainty analysis based on variance to determine probability ranges.

A further object of the invention is to provide a method for assessing the probability of production at a wellsite within a field, wherein the step of collecting data from an exploratory well, and the step of performing an uncertainty analysis based on variance to determine probability ranges further includes for each lithology within the exploratory well, identifying a range of porosities, identifying a range of saturations within the exploratory well, and identifying a range of permeability. The step of performing an uncertainty analysis further includes identifying a statistical probability distribution for each layer within the exploratory well. The step of performing an uncertainty analysis further includes performing a Monte Carlo type probability analysis on the statistical probability distribution to obtain a probability risk analysis for an overall probability of production from the wellsite, wherein the probability risk analysis includes a best case scenario, an expected scenario, and a worst case scenario.

A further object of the invention is to provide a method for assessing the probability of production at a wellsite within a field, wherein the step of collecting data from an exploratory well, and performing an uncertainty analysis on the data further comprises performing a productivity forecasting for structure composing compilation options.

A further object of the invention is to provide a method for assessing the probability of production at a wellsite within a field, wherein the step of performing the productivity forecasting for structure composing compilation options includes identifying how many production wells need to be implemented in the field in order to make the field economically viable. The step of performing the productivity forecasting for structure composing compilation options further includes identifying a most likely scenario and a most likely number of wells needed to meet an economic hurdle based on an expected scenario. The step of performing the productivity forecasting for structure composing compilation options further includes identifying a basic cash flow from a highest net-present value based on a best case scenario, the expected scenario, and a worst case scenario.

A further object of the invention is to provide a method for assessing the probability of production at a wellsite within a field, wherein the step of preparing the exploratory well for flow by performing at least one remedial measure on the wellbore of the exploratory well includes conditioning the sandface of the exploratory well to prepare the exploratory well for hydrocarbon flow, wherein the conditioning step includes at least one step selected from the group including drying the formation to evaporate water blockages, acid-etching the sandface of the wellbore, and using ultrasonic techniques to disperse any blockages. The step of preparing the exploratory well for flow by performing at least one remedial measure on the wellbore of the exploratory well further includes coiled tube jetting the exploratory well with an alcohol nitrogen mixture to dissolve any water blockages and to vaporize any water that is contacted. The step of preparing the exploratory well for flow by performing at least one remedial measure on the wellbore of the exploratory well further includes shutting in the wellbore prior to flow to allow absorption of the alcohol nitrogen mixture.

A further object of the invention is to provide a method for assessing the probability of production at a wellsite within a field, wherein the step of identifying an initial flow rate of hydrocarbons from a wellbore of the exploratory well includes inserting a velocity tube within a drill string texting tool to overcome liquid loading effects within the exploratory well. The step of identifying an initial flow rate of hydrocarbons from a wellbore of the exploratory well further includes isolating a hydrocarbon layer of the exploratory well with the drill string texting tool in order to identify at least one of a productive capacity, a pressure, a permeability or extent of the hydrocarbon layer. The step of identifying an initial flow rate of hydrocarbons from a wellbore of the exploratory well further includes identifying temperature profile at a constant reservoir pressure of the exploratory well by identifying a temperature gradient in a fiber optic cable, and inferring the flow from the exploratory well based on the temperature profile. The step of identifying an initial flow rate of hydrocarbons from a wellbore of the exploratory well further includes identifying whether the hydrocarbon layer is producing emissions.

A further object of the invention is to provide a method for assessing the probability of production at a wellsite within a field, wherein the step of performing a selected completion method on the exploratory well includes selecting a perforation strategy, wherein the perforation strategy is either an underbalanced perforation strategy or an overbalanced perforation strategy. The step of performing a selected completion method on the exploratory well further includes performing a diagnostic injection procedure of the exploratory well to identify natural stress fractures in the near wellbore area, and to evaluate a stress environment and a permeability environment in the near wellbore area. The step of performing a selected completion method on the exploratory well further includes identifying a fluid type, proppant type, and pump selection for formation cracking to maximize generation from a hydrocarbon layer and pay coverage of the wellsite. The step of performing a selected completion method on the exploratory well further includes identifying a post fracture profile by performing a coiled tubing cleanout and an annular flowback analysis.

A further object of the invention is to provide a method for assessing the probability of production at a wellsite within a field, wherein the step of evaluating results for the wellsite using a single well model further comprises performing post-fracture data collection and post-fracture uncertainty analysis of the exploratory well. The step of evaluating results for the wellsite using a single well model further comprises determining a predictive forecast of a post-fracture drainage pattern of the exploratory well.

A further object of the invention is to provide a method for assessing the probability of production at a wellsite within a field, wherein the step of determining a predictive forecast of a post-fracture drainage pattern of the exploratory well further comprises determining a predictive forecast of a post-fracture drainage pattern of the exploratory well based on a fracture length is detected as being generated from a hydraulic reservoir cracking and estimating an area within the field that is being drained which contributes to the increased hydrocarbon production.

A further object of the invention is to provide a method for assessing the probability of production at a wellsite within a field, wherein the step of upscaling the results to the field level comprises responsive to determining a predictive forecast of a post-fracture drainage pattern of the exploratory well based on a fracture length is detected as being generated from a hydraulic reservoir cracking and estimating an area within the field that is being drained which contributes to the increased hydrocarbon production, identifying a number of wells needed to be placed in order to drain the field over a certain period of time.

In view of the above problems, an object of the present invention is to provide a method for controlling a drilling operation for an oilfield. The method comprises collecting data from an exploratory well and performing an uncertainty analysis on the data. The method comprises preparing the exploratory well for flow by performing at least one remedial measure on the wellbore of the exploratory well. The method comprises identifying an initial flow rate of hydrocarbons from a wellbore of the exploratory well. The method comprises performing a selected completion method on the exploratory well. The method comprises determining a second flow rate of hydrocarbons from the wellbore to identify an increased production amount due to the remedial measure. The method comprises responsive to identifying the increased production amount due to the remedial measure, evaluating results for the wellsite using a single well model. The method comprises upscaling the results to a field level.

A further object of the invention is to provide a method for controlling a drilling operation for an oilfield, wherein collecting data from an exploratory well, and performing an uncertainty analysis on the data further comprises identifying information from well logs, mud logs, and drilling flowback taken from the exploratory well. Collecting data from an exploratory well, and performing an uncertainty analysis on the data further comprises characterizing a near wellbore fracture network as either a single porosity zone or a dual porosity zone.

A further object of the invention is to provide a method for controlling a drilling operation for an oilfield, wherein characterizing the near wellbore fracture network further comprises seismically characterizing the near wellbore fracture network by identifying at least one of a seismic velocity, a seismic shear, and a seismic impedance.

A further object of the invention is to provide a method for controlling a drilling operation for an oilfield, wherein collecting data from an exploratory well, and performing an uncertainty analysis on the data further comprises developing the single well model to incorporate the data.

A further object of the invention is to provide a method for controlling a drilling operation for an oilfield, wherein the step of developing the single well model includes incorporating information from well logs, mud logs, and drilling flowback taken from the exploratory well, as well as measurements taken away from the wellbore. The step of developing the single well model further includes ignoring effects from wells within the field that are not effects from the exploratory well. The step of developing the single well model further includes developing a continuous wellbore model from the single well model, wherein the continuous wellbore model gives a point by point assessment of the parameters in the exploratory well such that various layers and potential reservoirs within the wellsite can be identified.

A further object of the invention is to provide a method for controlling a drilling operation for an oilfield, wherein the step of collecting data from an exploratory well, and performing an uncertainty analysis on the data further comprises performing an uncertainty analysis based on variance to determine probability ranges.

A further object of the invention is to provide a method for controlling a drilling operation for an oilfield, wherein the step of collecting data from an exploratory well, and the step of performing an uncertainty analysis based on variance to determine probability ranges further includes for each lithology within the exploratory well, identifying a range of porosities, identifying a range of saturations within the exploratory well, and identifying a range of permeability. The step of performing an uncertainty analysis further includes identifying a statistical probability distribution for each layer within the exploratory well. The step of performing an uncertainty analysis further includes performing a Monte Carlo type probability analysis on the statistical probability distribution to obtain a probability risk analysis for an overall probability of production from the wellsite, wherein the probability risk analysis includes a best case scenario, an expected scenario, and a worst case scenario.

A further object of the invention is to provide a method for controlling a drilling operation for an oilfield, wherein the step of collecting data from an exploratory well, and performing an uncertainty analysis on the data further comprises performing a productivity forecasting for structure composing compilation options.

A further object of the invention is to provide a method for controlling a drilling operation for an oilfield, wherein the step of performing the productivity forecasting for structure composing compilation options includes identifying how many production wells need to be implemented in the field in order to make the field economically viable. The step of performing the productivity forecasting for structure composing compilation options further includes identifying a most likely scenario and a most likely number of wells needed to meet an economic hurdle based on an expected scenario. The step of performing the productivity forecasting for structure composing compilation options further includes identifying a basic cash flow from a highest net-present value based a best case scenario, the expected scenario, and a worst case scenario.

A further object of the invention is to provide a method for controlling a drilling operation for an oilfield, wherein the step of preparing the exploratory well for flow by performing at least one remedial measure on the wellbore of the exploratory well includes conditioning the sandface of the exploratory well to prepare the exploratory well for hydrocarbon flow, wherein the conditioning step includes at least one step selected from the group including drying the formation to evaporate water blockages, acid-etching the sandface of the wellbore, and using ultrasonic techniques to disperse any blockages. The step of preparing the exploratory well for flow by performing at least one remedial measure on the wellbore of the exploratory well further includes coiled tube jetting the exploratory well with an alcohol nitrogen mixture to dissolve any water blockages and to vaporize any water that is contacted. The step of preparing the exploratory well for flow by performing at least one remedial measure on the wellbore of the exploratory well further includes shutting in the wellbore prior to flow to allow absorption of the alcohol nitrogen mixture.

A further object of the invention is to provide a method for controlling a drilling operation for an oilfield, wherein the step of identifying an initial flow rate of hydrocarbons from a wellbore of the exploratory well includes inserting a velocity tube within a drill string texting tool to overcome liquid loading effects within the exploratory well. The step of identifying an initial flow rate of hydrocarbons from a wellbore of the exploratory well further includes isolating a hydrocarbon layer of the exploratory well with the drill string texting tool in order to identify at least one of a productive capacity, a pressure, a permeability or extent of the hydrocarbon layer. The step of identifying an initial flow rate of hydrocarbons from a wellbore of the exploratory well further includes identifying temperature profile at a constant reservoir pressure of the exploratory well by identifying a temperature gradient in a fiber optic cable, and inferring the flow from the exploratory well based on the temperature profile. The step of identifying an initial flow rate of hydrocarbons from a wellbore of the exploratory well further includes identifying whether the hydrocarbon layer is producing emissions.

A further object of the invention is to provide a method for controlling a drilling operation for an oilfield, wherein the step of performing a selected completion method on the exploratory well includes selecting a perforation strategy, wherein the perforation strategy is either an underbalanced perforation strategy or an overbalanced perforation strategy. The step of performing a selected completion method on the exploratory well further includes performing a diagnostic injection procedure of the exploratory well to identify natural stress fractures in the near wellbore area, and to evaluate a stress environment and a permeability environment in the near wellbore area. The step of performing a selected completion method on the exploratory well further includes identifying a fluid type, proppant type, and pump selection for formation cracking to maximize generation from a hydrocarbon layer and pay coverage of the wellsite. The step of performing a selected completion method on the exploratory well further includes identifying a post fracture profile by performing a coiled tubing cleanout and an annular flowback analysis.

A further object of the invention is to provide a method for controlling a drilling operation for an oilfield, wherein the step of evaluating results for the wellsite using a single well model further comprises performing post-fracture data collection and post-fracture uncertainty analysis of the exploratory well. The step of evaluating results for the wellsite using a single well model further comprises determining a predictive forecast of a post-fracture drainage pattern of the exploratory well.

A further object of the invention is to provide a method for controlling a drilling operation for an oilfield, wherein the step of determining a predictive forecast of a post-fracture drainage pattern of the exploratory well further comprises determining a predictive forecast of a post-fracture drainage pattern of the exploratory well based on a fracture length is detected as being generated from a hydraulic reservoir cracking and estimating an area within the field that is being drained which contributes to the increased hydrocarbon production.

A further object of the invention is to provide a method for controlling a drilling operation for an oilfield, wherein the step of upscaling the results to the field level comprises responsive to determining a predictive forecast of a post-fracture drainage pattern of the exploratory well based on a fracture length is detected as being generated from a hydraulic reservoir cracking and estimating an area within the field that is being drained which contributes to the increased hydrocarbon production, identifying a number of wells needed to be placed in order to drain the field over a certain period of time.

The presently described embodiments describe a new method for assessing the probability of production at a site. The process comprises the four steps of: 1) Data Collection and Uncertainty Analysis; 2) Wellsite Preparation; 3) Treatment Selection/Job Execution; and 4) Evaluation and Upscaling to Field Level.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE DRAWINGS

In a typical exploration phase of potential wellsites, once a structure containing hydrocarbons is located, either through seismic or other techniques, a plurality of exploratory wells are drilled into the field. From those exploratory wells, a determination is made as to whether the field can be developed into an economically viable production field. That is, operating engineers determine whether enough production can be extracted from the field to overcome the huge capital expenditure necessary to develop the site. The present invention is to provide methods, apparatuses and systems for assessing the probability of production at a wellsite.

Thus, the illustrative embodiments describe a "lite" field development plan. This is a coarse analysis that can be done within a manageable amount of time. Often during field development, companies will try and develop a full three dimensional numerical model of the entire field and then try to guess how many wells to put into the field. The present model develops a model for a single well (or a plurality of exploratory wells), and then extrapolates the data from that one well to the entire field.

The presently described embodiments describe a new method for assessing the probability of production at a site. The process comprises the four steps of: 1) Data Collection and Uncertainty Analysis; 2) Wellsite Preparation; 3) Treatment Selection/Job Execution; and 4) Evaluation and Upscaling to Field Level.

Figure 1:
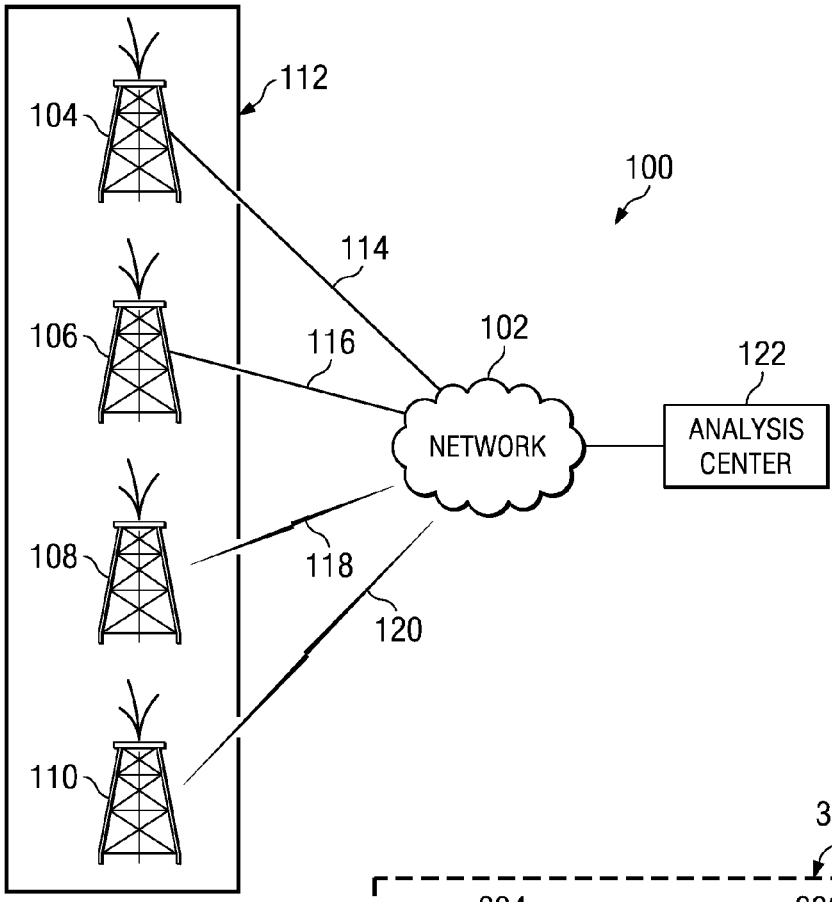
FIG. 1 is a pictorial representation of a network of data acquisition system in accordance with an illustrative embodiment.

With reference now to FIG. 1, a pictorial representation of a network data acquisition system is depicted in which a preferred embodiment of the present invention may be implemented. In this example, network data acquisition system 100 is a network of computing devices in which different embodiments of the present invention may be implemented. Network data acquisition system 100 in these examples is used to collect data, analyze data, and make decisions with respect to the life cycle of different natural resources, such as oil and gas. Different stages in this life cycle include exploration, appraisal, reservoir development, production decline, and abandonment of the reservoir. In these different phases, network data acquisition system 100 is used to make decisions to properly allocate resources to assure that the reservoir meets its production potential.

Network data acquisition system 100 includes network 102, which is a medium used to provide communications links between various devices and computers in communication with each other within network data acquisition system 100. Network 102 may include connections, such as wire, wireless communications links, or fiber optic cables. The data could even be delivered by hand with the data being stored on a storage device, such as a hard disk drive, DVD, or flash memory.

In this depicted example, wellsites 104, 106, 108, and 110 have computers or other computing devices that produce data regarding wells located at these wellsites. In these examples, wellsites 104, 106, 108, and 110 are located in geographic region 112. This geographic region is a single reservoir in these examples. Of course, these wellsites may be distributed across diverse geographic regions and/or over multiple reservoirs, depending on the particular implementation. These wellsites may be wellsites that are being developed or ones in which production is occurring. In these examples, wellsites 104 and 106 have wired communications links 114 and 116 to network 102. Wellsites 108 and 110 have wireless communications links 118 and 120 to network 102.

Analysis center 122 is a location at which data processing systems, such as servers are located to process data collected from wellsites 104, 106, 108, and 110. Of course, depending on the particular implementation, multiple analysis centers may be present. These analysis centers may be, for example, at an office or an on-site in geographic region 112 depending on the particular implementation. In these illustrative embodiments, analysis center 122 analyzes data from wellsites 104, 106, 108, and 110 using processes for different embodiments of the present invention.

In the depicted example, network data acquisition system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational and other computer systems that route data and messages. Of course, network data acquisition system 100 also may be implemented as a number of different types of networks, such as for example, an intranet, a local area network (LAN), or a wide area network (WAN). FIG. 1 is intended as an example, and not as an architectural limitation for different embodiments.

Figure 2:
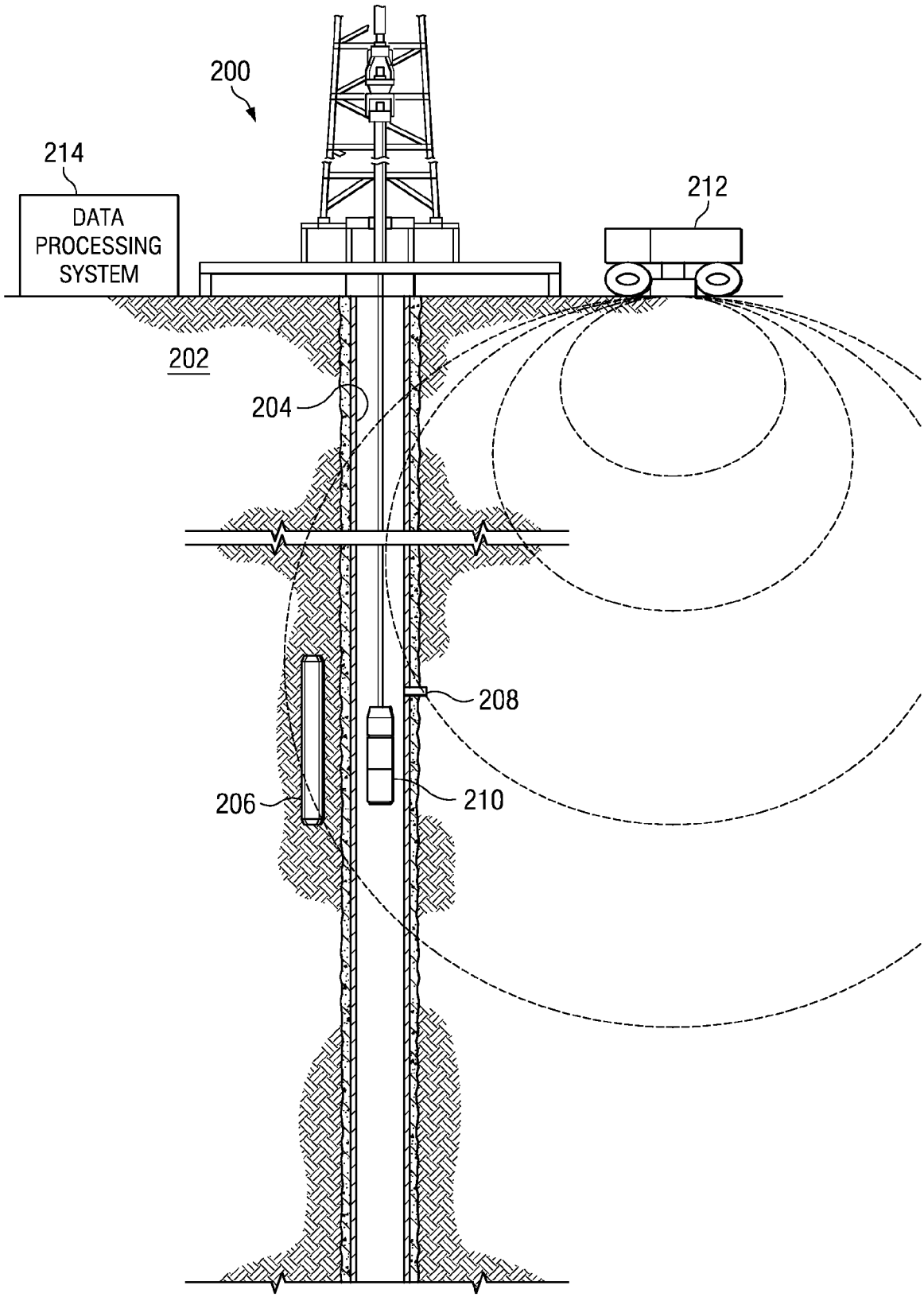
FIG. 2 is a diagram illustrating a wellsite from which data is obtained in accordance with a preferred embodiment of the present invention.

Turning now to FIG. 2, a diagram illustrating a wellsite from which data is obtained is depicted in accordance with a preferred embodiment of the present invention. Wellsite 200 is an example of a wellsite, such as wellsite 104 in FIG. 1. The data obtained form wellsite 200 is referred to as multi-dimensional data in these examples.

In this example, wellsite 200 is located on formation 202. During the creation of wellbore 204 in formation 202, different samples are obtained. For example, core sample 206 may be obtained as well as sidewall plug 208. Further, logging tool 210 may be used to obtain other information, such as pressure measurements and factor information. Further, from creating wellbore 204, drill cuttings and mud logs are obtained.

Other information, such as seismic information also may be obtained using seismic device 212. This information may be collected by data processing system 214 and transmitted to an analysis center, such as analysis center 122 in FIG. 1 for analysis. For example, seismic measurements made by seismic device 212 may be collected by data processing system 214 and sent for further analysis.

The information collected at wellsite 200 may be divided into groups of continuous data and groups of discrete data. The continuous data may be wellsite data or laboratory data and the discrete data also may be wellsite data or laboratory data in these examples. Wellsite data is data obtained through measurements made on the well, while laboratory data is made from measurements obtained from samples from wellsite 200. For example, continuous wellsite data includes, for example, seismic, log/log suite and measurements while drilling. Continuous laboratory data includes, for example, strength profiles and core gamma information. Discrete wellsite data includes, for example, sidewall plugs, drill cuttings, pressure measurements, and gas flow detection measurements. The discrete laboratory data may include, for example, laboratory measurements made on plugs or cores obtained from wellsite 200. Of course, the different illustrative embodiments may be applied to any continuous wellsite data, continuous laboratory data, discrete wellsite data, and discrete laboratory data in addition to or in place of those illustrated in these examples.

The images of core samples and other data measured or collected by devices at wellsite 200 may be sent to data processing system 214 for transmission to the analysis center. More specifically, the multi-dimensional data may be input or received by data processing system 214 for transmission to an analysis center for processing. Alternatively, depending on the particular implementation some or all processing of the multi-dimensional data from wellsite 200 may be performed using data processing system 214. For example, data processing 214 may be used to preprocess the data or perform all of the analysis on the data from wellsite 200. If all the analysis is performed using data processing system 214 the results may then be transmitted to the analysis center to be combined from results from other wellsites to provide additional results.

Figure 3:
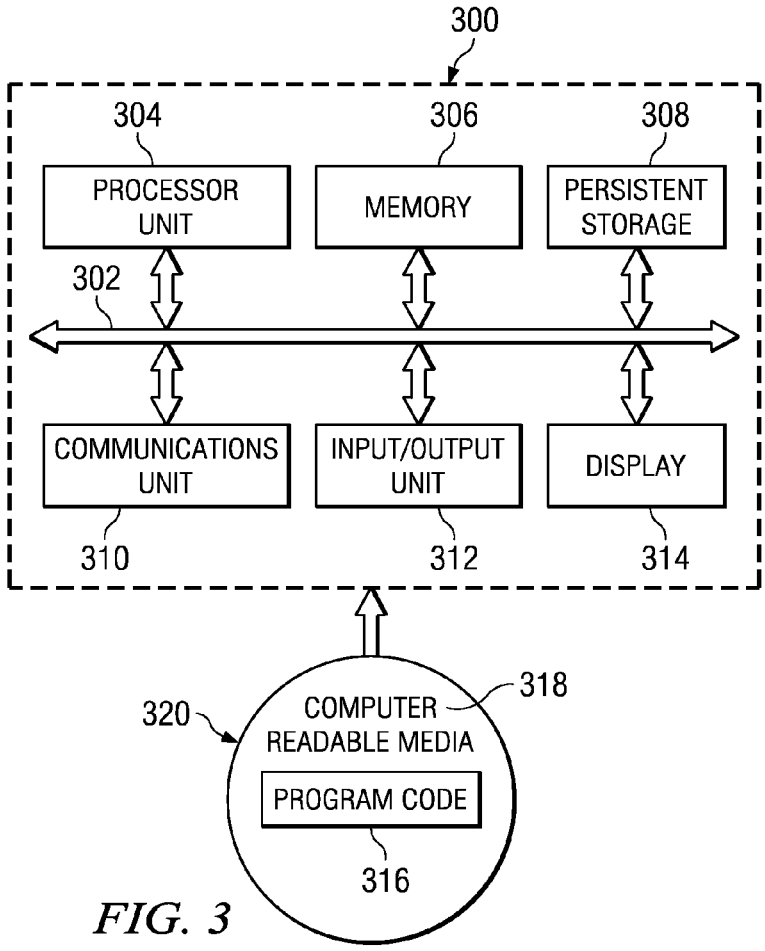
FIG. 3 is a diagram of a data processing system in accordance with an illustrative embodiment of the present invention.

Turning now to FIG. 3, a diagram of a data processing system is depicted in accordance with an illustrative embodiment of the present invention. In this illustrative example, data processing system 300 includes communications fabric 302, which provides communications between processor unit 304, memory 306, persistent storage 308, communications unit 310, input/output (I/O) unit 312, and display 314.

Processor unit 304 serves to execute instructions for software that may be loaded into memory 306. Processor unit 304 may be a set of one or more processors or may be a multiprocessor core, depending on the particular implementation. Further, processor unit 304 may be implemented using one or more heterogeneous processor systems in which a main processor is present with secondary processors on a single chip. As another illustrative example, processor unit 304 may be a symmetric multi-processor system containing multiple processors of the same type.

Memory 306, in these examples, may be, for example, a random access memory or any other suitable volatile or non-volatile storage device. Persistent storage 308 may take various forms depending on the particular implementation. For example, persistent storage 308 may contain one or more components or devices. For example, persistent storage 308 may be a hard drive, a flash memory, a rewritable optical disk, a rewritable magnetic tape, or some combination of the above. The media used by persistent storage 308 also may be removable. For example, a removable hard drive may be used for persistent storage 308.

Communications unit 310, in these examples, provides for communications with other data processing systems or devices. In these examples, communications unit 310 is a network interface card. Communications unit 310 may provide communications through the use of either or both physical and wireless communications links.

Input/output unit 312 allows for input and output of data with other devices that may be connected to data processing system 300. For example, input/output unit 312 may provide a connection for user input through a keyboard and mouse. Further, input/output unit 312 may send output to a printer. Display 314 provides a mechanism to display information to a user.

Instructions for the operating system and applications or programs are located on persistent storage 308. These instructions may be loaded into memory 306 for execution by processor unit 304. The processes of the different embodiments may be performed by processor unit 304 using computer implemented instructions, which may be located in a memory, such as memory 306. These instructions are referred to as, program code, computer usable program code, or computer readable program code that may be read and executed by a processor in processor unit 304. The program code in the different embodiments may be embodied on different physical or tangible computer readable media, such as memory 306 or persistent storage 308.

Program code 316 is located in a functional form on computer readable media 318 and may be loaded onto or transferred to data processing system 300 for execution by processor unit 304. Program code 316 and computer readable media 318 form computer program product 320 in these examples. In one example, computer readable media 318 may be in a tangible form, such as, for example, an optical or magnetic disc that is inserted or placed into a drive or other device that is part of persistent storage 308 for transfer onto a storage device, such as a hard drive that is part of persistent storage 308. In a tangible form, computer readable media 318 also may take the form of a persistent storage, such as a hard drive or a flash memory that is connected to data processing system 300. The tangible form of computer readable media 318 is also referred to as computer recordable storage media.

Alternatively, program code 316 may be transferred to data processing system 300 from computer readable media 318 through a communications link to communications unit 310 and/or through a connection to input/output unit 312. The communications link and/or the connection may be physical or wireless in the illustrative examples. The computer readable media also may take the form of non-tangible media, such as communications links or wireless transmissions containing the program code.

The different components illustrated for data processing system 300 are not meant to provide architectural limitations to the manner in which different embodiments may be implemented. The different illustrative embodiments may be implemented in a data processing system including components in addition to or in place of those illustrated for data processing system 300. Other components shown in FIG. 3 can be varied from the illustrative examples shown.

For example, a bus system may be used to implement communications fabric 302 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 306 or a cache such as found in an interface and memory controller hub that may be present in communications fabric 302.

Figure 4:
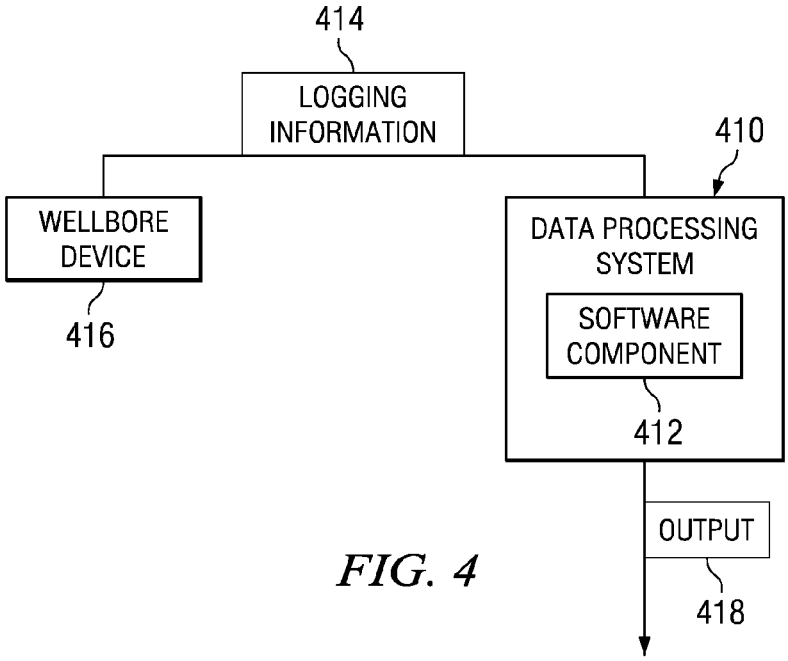
FIG. 4 is a data flow diagram showing the flow of information between various components of the present invention according to an illustrative embodiment.

Referring now to FIG. 4, a data flow diagram showing the flow of information between various components of the present invention is shown according to an illustrative embodiment. FIG. 4 shows the flow of data between the components of a data processing system, such as data processing 214 of FIG. 2, and wellbore measurement tools, such as logging tool 210 of FIG. 2.

Data processing system 410 executes software component 412. Data processing system can be data processing system 214 of FIG. 2. Data processing system 410 receives logging information 414 from wellbore device 416. Wellbore device 416 can be logging tool 210 of FIG. 2.

Responsive to receiving logging information 414, software component 412 calculates the probability of economically viable production from the field, based on logging information 414. Software component 412 can then create field models and other output 418 that can be delivered to an operator, or field engineer. The operator or engineer can use the information in his evaluation of the economic viability of the wellsite, including the planning of locations and numbers of any drilling sites for production wells.

Figure 5:
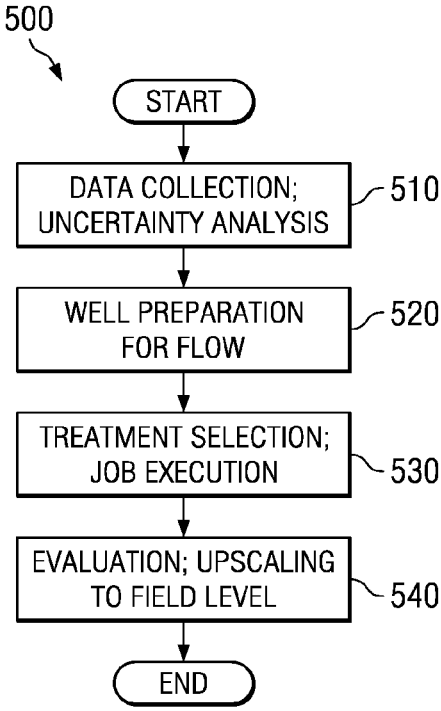
FIG. 5 is a flowchart of processing steps for assessing the probability of production at a wellsite according to an illustrative embodiment.

Referring now to FIG. 5, a flowchart of processing steps for assessing the probability of production at a wellsite is shown according to an illustrative embodiment. Process 500 is a process for developing a wellsite, such as wellsite 200 of FIG. 2. Portions of process 500 are software processes, which execute on a software component, such as software component 412 of FIG. 4, of a data processing system, such as analysis center 122 of FIG. 1 and data processing system 214 of FIG. 2.

Process 500 begins by collecting data from an exploratory well, and performing an uncertainty analysis on the data (step 510). Process 500 determines at each step of production of the exploratory well, what residual properties are currently known, and from that determines what type of data still needs to be collected. Once a statistical grouping of data is collected on the small number of exploratory wells, process 500 expands this statistical grouping of data to create a statistical probability range around the collected data. Data can be segmented into high, mean, and low values.

Process 500 continues in well preparation for flow (step 520). Depending on the measured reservoir properties, the high, mean, and low values providing the probability range informs an operator how to further prepare an exploratory well such that better data, including a dynamic flow of the reservoir's hydrocarbons, can be obtained in a subsequent test period. A dynamic flow data allows process 500 to determine a predicted production model, which can then be used to determine basic economics of the well. Process 500 then inputs the information into a single well model that performs a probability analysis, and can create visualizations of the expected field production and drainage patterns, based on the probability range.

For each visualization built around the identified probability range, a Monte Carlo type probability analysis can be performed to determine the overall probability of production from the wellsite. A Monte Carlo analysis is simply one way to provide a relevant statistical analysis of a system having a large number of variables. Other similar statistical treatments may also be used.

A similar analysis is performed on each identified layer within the field, so that a virtual simulation of the reservoir is developed for each layer of the field. For each random set of probability combinations, a reservoir lithology is determined. From the reservoir lithology, a production analysis is run on each of layer, and then a distribution is performed across the data. The likely productivity range of producing wells in the field is then known.

Process 500 continues by performing a treatment selection and job execution (step 530) on at least one of the exploratory wells. Treatment of the well comprises one or more remedial measures, such as, for example, acid etching or hydraulic fracturing. After remedial measures are performed, a determination is made as to how much gain was made from the untreated well to the well treated with remedial measures. That is, a determination is made as to how much hydrocarbon flow has increased due to the remedial measure performed.

Finally, process 500 evaluates the results for the single well model, and upscales those results to the field level (step 540), with the process terminating thereafter. Based on the obtained probability range, a field development plan can be generated. A probable determination of how many wells would need to be placed into the field for each probability range can be identified in order to develop the field. An economic analysis of the data can also be run to determine the viability of developing the reservoir at the wellsite.

Thus, process 500 basically provides a "lite" field development plan. Process 500 is a coarse analysis that can be done within a manageable amount of time, as opposed to developing a full three dimensional numerical model of the entire field and then attempting to guesstimate how many wells to put into the field. The present model develops a model for a single well (or a plurality of exploratory wells), and extrapolates the data for that one well to the entire field.

Figure 6:
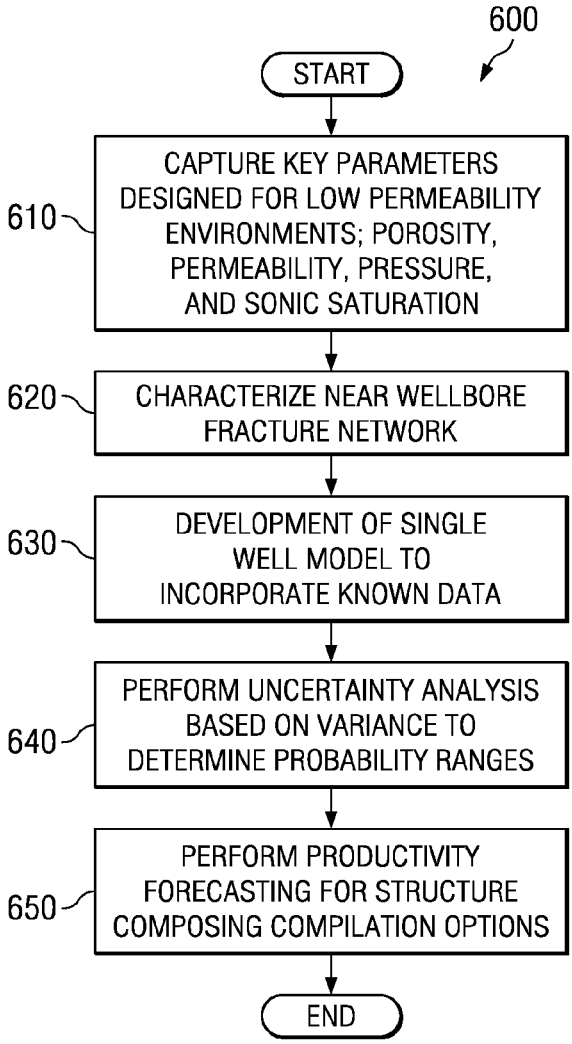
FIG. 6 is a flowchart for processing steps for collecting data from an exploratory well and performing an uncertainty analysis thereon, according to an illustrative embodiment.

Referring now to FIG. 6, a flowchart is provided of processing steps for collecting data from an exploratory well and performing an uncertainty analysis thereon, according to an illustrative embodiment. Process 600 is a software process executing on a software component, such as software component 412 of FIG. 4, executing on a data processing system, such as analysis center 122 of FIG. 1 and data processing system 214 of FIG. 2. Process 600 is a more detailed description of step 510 of FIG. 5.

Process 600 begins by capturing key parameters (step 610). The key parameters are determined from well logs and other data taken from the exploratory well, such as wellsite 200 of FIG. 2, as measured by a logging tool, such as logging tool 210 of FIG. 2.

The key parameters are a combination of direct measurements and observations. The main aspect of this is to understand the permeability range at the wellsite so that a correct methodology for obtaining the key parameters can be used. In one illustrative embodiment, if the wellsite is in a high permeability environment, an operator will know that the flow potential of any reservoirs within that wellsite will have key parameters that are very different from the key parameters that might be observed at a wellsite in a low permeability environment. This can be determined even prior to beginning well logging of the flow potential of the reservoir.

From a macro scale, drilling observations are obtained, and analysis of those drilling observations is obtained, either from mud logs or drilling flowback. From a micro standpoint, the type of logs that might be run during drilling could change in order to determine the permeability range for the reservoir.

Process 600 continues by characterizing the near wellbore fracture network (step 620). That is, process 600 determines whether the reservoir is a single porosity zone, consisting of an unfractured reservoir matrix, or whether the reservoir is a dual porosity zone, consisting of a fractured reservoir matrix. Determination of the characterization can be performed seismically, such as with seismic device 212 of FIG. 2.

By understanding whether the area proximate to the wellbore is a single porosity zone or a dual porosity zone, a better determination can be made as to how to characterize the wellbore—that is, does the zone have simply matrix permeability (a single porosity) or matrix permeability and fractures therein (a dual porosity). If the zone is a dual porosity zone, for example, the zone has fractures, a characterization of the fracture both proximate to, and distal from the wellbore should be made by process 600. This proximate and distal characterization can be accomplished through the use of a velocity/shear/impedance tool, which can be seismic device 212 of FIG. 2.

Process 600 continues by developing a single well model to incorporate known data (step 630). A single well model can be determined by combining all the measured data from the well, such as mud logs, plus all of the measurements away from the wellbore, such as seismic data. The single well model created from this collected data is relevant to both the wellbore and a quantified distance away from the wellbore. A single well model assumes that there is only one well in the field, and ignores the effects of other wells within the field. The single well model therefore gives a simplified numerical analysis of the flow of hydrocarbons from the reservoir into the well.

Information from the log data is incorporated into a single well model, which provides a determination of what is happening right at the wellbore. The information of the single well model can be broken into a continuous wellbore model, which gives a point by point assessment of the parameters in the well such that the various layers and potential reservoirs within the well can be identified. Each layer within the wellbore may represent a particular lithology within the wellbore. The well itself may have multiple lithologies.

Each lithology has a range of porosities, saturations, permeability, and other parameters as measured at different points within the field. Therefore, in one illustrative embodiment, if three exploratory wells are drilled within a field, each exploratory well will have a group of parameters for each lithology therein.

Process 600 then performs an uncertainty analysis based on variance to determine probability ranges (step 640). From the plurality of exploratory wells and the range of porosities, saturations, permeability, and other parameters associated with each lithology therein, a probability of the parameters, based on the properties observed in each of the lithology can be identified.

The three exploratory wells can be scaled up to obtain an approximation of the values that will be present throughout the field. The same analysis is performed on each exploratory well.

By way of example, in one illustrative embodiment, three exploratory wells—well 1, well 2, and well 3—have been drilled in a field. Each exploratory well traverses three layers having different lithologies—layer A, layer B, and layer C. That is, each layer has separate porosity, saturation, and permeability properties that are separately measured. A statistical analysis is performed for each property within each layer. That is, layer A of well 1 is compared only with layer A of wells 2 and 3. Layer A of well 1 is not compared with layers B and C from any of the three wells.

A statistical probability distribution can therefore be identified for each layer. There is a range for each parameter of each layer within the field. A mean, a median, a low, and a high value are obtained.

A Monte Carlo type probability analysis can be performed to determine the overall probability of production from the wellsite. A Monte Carlo analysis is simply one way to provide a relevant statistical analysis of a system having a large number of variables. Other similar statistical treatments may also be used.

A similar analysis is performed on each identified layer within the field, so that a virtual simulation of the reservoir is developed for each layer of the field. For each random set of probability combinations, a reservoir lithology is determined. From the reservoir lithology, a production analysis is run on each layer, and then a distribution is performed across the data. The likely productivity range of producing wells in the field is then known.

In one illustrative embodiment, a Monte Carlo type statistical probability assessment is performed on the statistical probability data to create a probability risk analysis. The Monte Carlo analysis will run any number of iterations. From those iterations, a best case scenario (p90), an expected scenario (p50), and a worst case scenario (p10) can be obtained. The combination of parameters entered into the Monte Carlo probability assessment mimics the uncertainty inherent in drilling production wells in the field.

Each visualization scenario, for example, the p90 scenario, the p50 scenario, and the p10 scenario, results in a production plot. Similarly, a cumulative production plot can be made for each visualization. Performing a distribution of the visualizations results in a cumulative production distribution.

Process 600 then performs a productivity forecasting for structure composing compilation options (step 650), with the process terminating thereafter. From the cumulative production distribution, a determination can be made as to how many wells need to be implemented into the field in order to make the field economically viable. A certain number of wells are predicted for each of the p10, p50, and p90 scenarios. Process 600 determines which is the most likely scenario and the number of wells needed to meet the economic hurdle based on the most probable scenario. The p90 best case scenario typically requires a lower number of wells that need to be implemented in the field in order to drain the field within the desired economic time frame.

Process 600 can perform a productivity forecast for the structure composing compilation options. Based on estimated operating costs of the field, process 600 can run an analysis of what is going to provide the highest net-present value (NPV) based on each of the p10, p50, and p90 scenarios. That analysis will provide a basic cash flow. Because the number of wells needed to meet the economic hurdle was previously determined, combining that determination with the basic cash flow, process 600 can determine the expected economic return from the field. All of this data can then be used in determining a field development plan.

Figure 7:
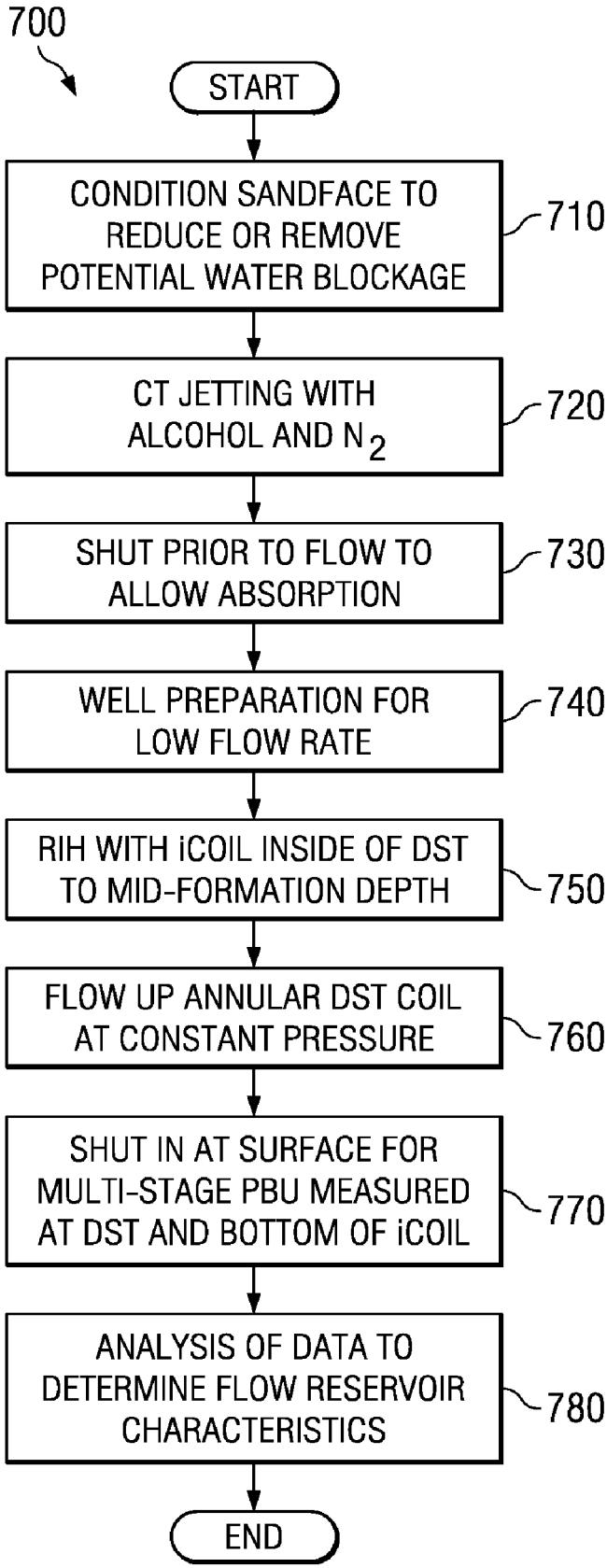
FIG. 7 is a process of well preparation for a low rate production analysis according to an illustrative embodiment of the current invention.

Referring now to FIG. 7, a process of well preparation for a low rate production analysis is described according to an illustrative embodiment of the current invention. Process 700 is a process occurring within an exploratory wellbore, such as wellbore 204 of FIG. 2. Process 700 is a more detailed description of step 520 of FIG. 5.

Well preparation of process 700 typically occurs within low permeability reservoirs—that is, the reservoir does not have enough internal pressure to produce a measurable flow potential. Typical well exploration drills a relatively large hole in diameter into the reservoir—6.25 inches diameter. This large diameter hole has been chosen to measure natural flow coming from the reservoir. However, if the reservoir has a permeability of 0.5 millidarcy or less, there might not be enough natural flow, even if a significant amount of hydrocarbons are present within the reservoir, (to get through the well to offload whatever fluid is in the wellbore.) Therefore, the well does not flow, or flows at a rate that is immeasurable. The well will build up pressure, and hydrocarbon may be observed in the reservoir. However, any attempts at measuring flow from the reservoir will not produce stable rate flow. Thus, process 700 attempts to put the well in a condition that is conducive to flow at low rates.

Process 700 begins by conditioning the sandface to prepare the well for hydrocarbon flow (step 710). The preparations include removing damage from within the wellbore, and drying the formation.

During well drilling, the porous nature of the formation can be compromised, or blocked, preventing reservoir fluids from properly flowing into the wellbore. Damage to the wellbore is generally caused by the invasion of drilling mud, drill cuttings, other particulates or even dissolved particulates in the reservoir water. To obtain accurate information regarding the possible production characteristics of the reservoir, the damage to the wellbore must be removed.

Removing damage from the wellbore comprises various mechanisms for unblocking the pores of the formation adjacent to the wellbore. By way of a non-limiting example, damage removal can be accomplished by drying the formation to evaporate water blockages, acid-etching the surface of the wellbore, and using ultrasonic techniques to disperse any blockages.

Process 700 next performs coiled tube jetting with an alcohol nitrogen mixture (step 720). The formation is dried to alleviate any potential water blocks around the wellbore. A coiled tubing jet is typically lowered into the wellbore. A fluid, gas, or mixture thereof is then jetted into the wellbore. The fluid/gas mixture generally selected should be readily miscible with water, and have a low heat of vaporization, and have a low humidity or water partial. These properties ensure that the fluid will readily dissolve any water blockages, and vaporize any water that is contacted. The fluid can be a nitrogen/alcohol mixture. The wellbore is then jetted with the fluid mixture.

The wellbore is then shut prior to flow to allow absorption (step 730). The wellbore is then sealed, and the mixture is allowed to absorb into the rock matrix surrounding the wellbore. When the low vapor pressure of the mixture evaporates water blockages within the wellbore, it allows reservoir fluids to flow into the wellbore more freely.

Process 700 then continues by preparing to measure emissions from the low flow rate reservoir (step 740).

After a period of time, the well is then opened. A velocity string inside a drill string testing tool is inserted into the wellbore to a mid-formation depth (step 750).

A velocity string is a small-diameter tubing string run inside the production tubing of a well, typically as a remedial treatment, to resolve liquid-loading problems. In reservoirs having low pressures, there may be insufficient velocity to transport all liquids from the wellbore. In time, these liquids accumulate and impair production. A velocity string reduces the flow area and increases the flow velocity to enable liquids to be carried from the wellbore. Velocity strings are commonly run using coiled tubing as a velocity string conduit. Safe live-well working and rapid mobilization enable coiled tubing velocity strings to provide a cost effective solution to liquid loading in gas wells.

A drill string test is a procedure to determine the productive capacity, pressure, permeability or extent (or a combination of these) of a hydrocarbon reservoir. While several different proprietary hardware sets are available to accomplish this, the common idea is to isolate the zone of interest with temporary packers. Next, one or more valves are opened to produce the reservoir fluids through the drillpipe and allow the well to flow for a time. Finally, the operator kills the well, closes the valves, removes the packers and trips the tools out of the hole. Depending on the requirements and goals for the test, it may be a short (one hour or less) or long (several days or weeks) duration, and there might be more than one flow period and pressure buildup period. The drill string testing device can be logging tool 210 of FIG. 2.

The drill string testing device can be an advanced optical Downhole Sensor and Pressure Package like an iCOIL* optical-fiber-installed CT string tool, available from Schlumberger Ltd., that enables measurement of depth correlation, bottomhole pressure, and temperature in real time. Information is transmitted to the control cabin, enabling decisions to be made instantly. Applications for this technology include nitrogen lift, matrix stimulation, cleanouts, sliding sleeve door shifting, logging, perforating, cementing, and plug placing-wherever real-time data enhances operational treatment efficiency.

Flow from the reservoir is then determined at a constant reservoir pressure (step 760). In one illustrative embodiment, the velocity string may include a fiber optic cable capable of measuring a temperature profile. By recording the temperature gradient within the wellbore as it is determined by the fiber optic cable, flow from specific points in the reservoir, for example, separate layers of the reservoir can be identified. One illustrative embodiment, therefore, does not measure flow from the wellbore with a spinner log, but rather infers flow rate from the temperature gradient as recorded by the fiber optic cable. Various zones throughout the wellbore in which there is a temperature change can then be identified. The change in temperature can be measured with surface equipment and processed by a data processing system, such as analysis center 122 of FIG. 1 and data processing system 214 of FIG. 2.

Responsive to measuring a discernible flow at the surface, the wellbore is shut in at the surface for a multi-stage pressure build up analysis, both at the drill string testing device, and at the bottom of the velocity string (step 770). The wellbore is shut again, and the pressure is allowed to build up. Pressure within the wellbore is then measured at various intervals along the fiber optic enabled coiled tubing. Wellbore pressure is measured at the bottom of the wellbore, and right at the bottom of the casing. This plurality of pressure measurements within the wellbore provides a very detailed build up, allowing a greater understanding of whatever effects are happening within the well.

An analysis of the data is then performed to determine the flow characteristics of the reservoir (step 780), with the process terminating thereafter. Pressure readings, porosity profiles, temperature profiles, as well as information obtained from DST analysis, that were obtained from the well are sent to a data processing system, such as analysis center 122 of FIG. 1 and data processing system 214 of FIG. 2. From this information, specific layers within the wellbore that are producing emissions can be identified. The production identification can then be used to determine the permeability of the producing strata of the wellbore to within 1 millidarcy.

Figure 8:
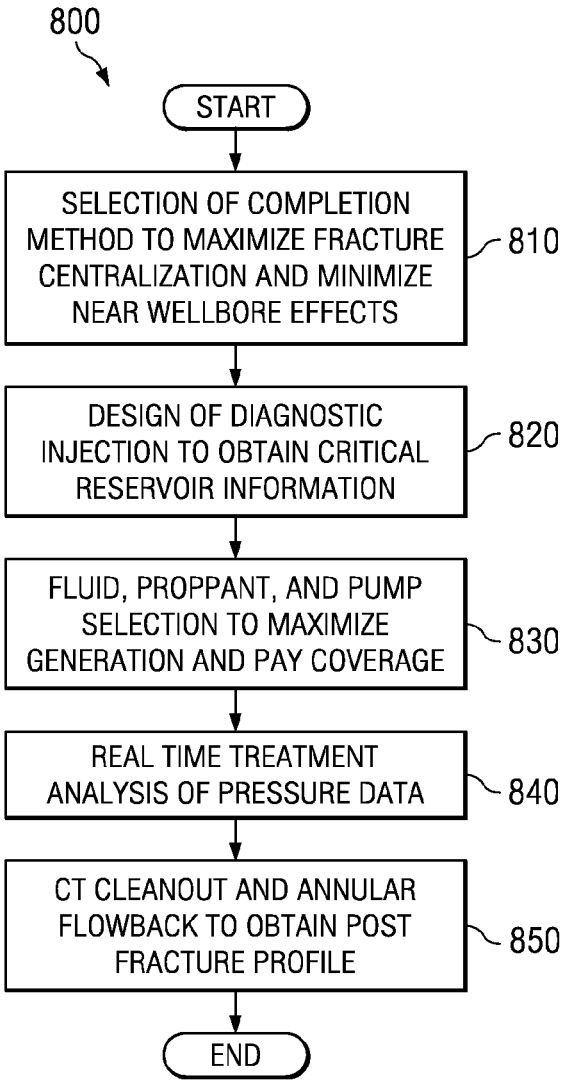
FIG. 8 is a process for selecting a wellbore stimulation treatment to be applied to the wellbore according to an illustrative embodiment.

Referring now to FIG. 8, a process for selecting a wellbore stimulation treatment to be applied to the wellbore is shown according to an illustrative embodiment. Process 800 is a more detailed description of step 530 of FIG. 5.

Process 800 begins by selecting a completion method to maximize fracture centralization and minimize near-wellbore effects (step 810). The completion method is a perforation strategy that is selected depending upon the determined characteristics of the rock matrix surrounding the wellbore.

Perforation strategies are determined by the stress profile of the rock within the different layers. The selected perforation strategy can be either an overbalanced pressure, or an underbalanced pressure within the wellbore. The selected perforation strategy can utilize any variety of gun systems or other systems based on the rock matrix's stress profile or other considerations. Gun systems may include, but are not limited to, high shot density gun systems, high efficiency gun systems, port plug gun systems, strip gun systems, hollow carrier gun systems, exposed gun systems, and pivot carrier gun systems An underbalanced perforation strategy involves reducing the pressure within so that the wellbore pressure is less than the pressure of the surrounding reservoir. Because debris from the perforation is largely drawn into the wellbore, and not ejected into the reservoir perforation, an underbalanced perforation strategy will often result in a cleaner perforation that allows for greater production. However, performing an underbalanced perforation is more complex and expensive than performing an overbalanced perforation. Thus, a determination must be made as to whether the rock matrix and expected yields from the well justify the added complexity of the underbalanced perforation.

To the contrary, an overbalanced perforation strategy maintains a wellbore pressure that is greater than the pressure in the surrounding reservoir. Therefore, debris from the perforation is generally blown outward from the wellbore, and into the perforations. Overbalanced perforations are typically chosen where there is a need for speedy analysis, or where a larger gun with a higher shot density is needed to perforate the rock matrix. However, the selection of whether to perform an overbalanced perforation or an underbalanced perforation largely rests on weighing the expected economics of the well against the added production time and expenditures necessitated by an underbalanced system.

Process 800 then designs a diagnostic injection of the wellbore to obtain critical reservoir information (step 820).

Diagnostic injections are fluid injections into the wellbore prior to any main hydrostatic treatment of the wellbore. Fluid injections are typically made to determine the closure stress, the magnitude of near wellbore friction (or fracture tortuosity), as well as the number of effective perforations accepting fluid. By preceding fracture treatments with the diagnostic injection procedure, an evaluation of the stress and permeability environment in the near wellbore area can be better determined. Natural stress fractures, along which hydraulic treatments will tend to propagate, and can be better identified.

Process 800 next determines a fluid type, proppant type, and pump selection to maximize generation and pay coverage (step 830).

The ideal fracture fluid must perform two roles. The ideal fracture fluid must first be capable of readily carrying the proppant deep within the newly created hydraulic fracture. The fracture fluid should then flow readily out of the fracture, leaving the proppant in place. Fracture fluids, such as guar and other polymeric systems, are typically used. However depending on the rock matrix and wellbore environment, other natural or polymeric fracture fluids can be used.

Operators use various grain sizes and proppant types, including natural sand, custom sieved sand, resin coated sand, and intermediate or high strength man made ceramic proppants depending on formation stress and fracture closure pressure. Proppants for packing should provide an effective permeability constant to facilitate hydrocarbon removal. Ideal proppants should prevent sand influx, fines migration, minimize proppant embedment in soft rock, and maintain fracture conductivity without proppant crushing.

Recently operators have shown a preference for larger, stronger, and more conductive proppants over natural sand. Man made ceramic materials have since become the proppant of choice in order to maintain fracture conductivity under the higher stresses found in deep formations. These larger and stronger proppants are provided with a more uniform spherical shape than natural sand, which helps to prevent embedment, while maintaining fracture conductivity.

The pump selected for the hydraulic fracture should provide enough pressure to overcome the internal pressure of the reservoir, and pump the fracture fluid, and the proppant into the hydraulic fracture. However, the pump should not be so strong that it causes additional damage to the reservoir by forcing proppant or excess fracture fluid into the porosity structure of the surrounding rock. Therefore, proper pump selection takes into account the wellbore pressure, as well as information collected about the rock matrix from the drilling log. Centrifugal pumps, diaphragm pumps, and down-hole pneumatic pumps, as well as other pumps known in the art are all viable alternatives, provided that the specific pump takes into account these delineated limitations.

The fracturing fluid is pumped into the wellbore at a rate sufficient to increase the downhole pressure to a value in excess of the fracture gradient of the formation rock. The increased pressure then causes the formation rock to crack which allows the fracturing fluid to enter and extend the crack further into the formation.

Process 800 provides real time treatment analysis of pressure data immediately post-fracture (step 840). Downhole Sensor and Pressure Package is an iCOIL* optical-fiber-installed CT string tool that enables measurement of depth correlation and bottomhole pressure and temperature in real time. Information is transmitted to the control cabin, enabling decisions to be made instantly. Applications for DSP2 technology include nitrogen lift, matrix stimulation, cleanouts, sliding sleeve door shifting, logging, perforating, cementing, and plug placing-wherever real-time data enhances operational treatment efficiency. Another benefit of DSP2 technology is the ability to disconnect the downhole tools by means of ball disconnect versus straight pull disconnect.

Process 800 then performs a coiled tubing cleanout and an annular flowback analysis to obtain a post fracture profile (step 850), with the process terminating thereafter. The coiled tubing cleaning device is used to purge the well bottom of fracture sediment. A Downhole Sensor and Pressure Package, such as logging tool 210 of FIG. 2, is run back into the well, along with a coil tubing. Flowback from the well is analyzed to obtain a post fracture profile of the wellbore.

Figure 9:
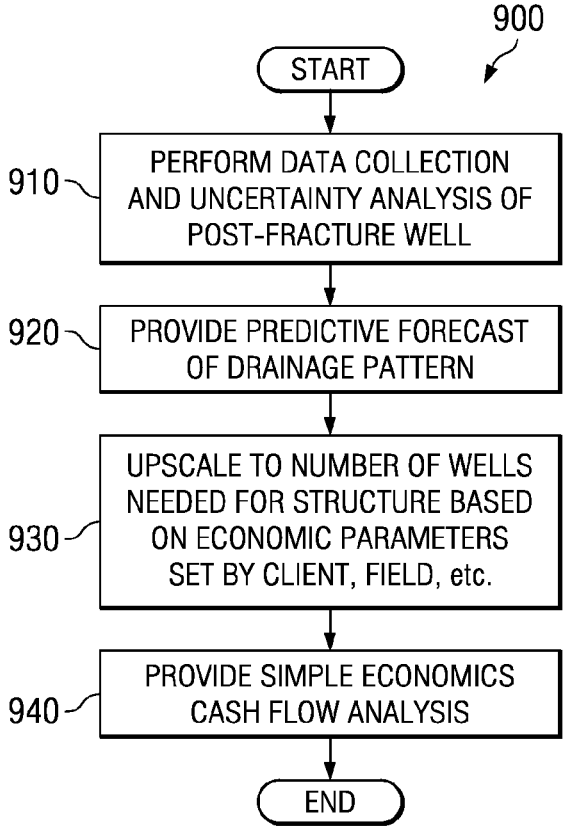
FIG. 9 is a process for evaluating a post-fracture wellbore, and upscaling the single-well model to provide field level analysis according to a preferred embodiment.

Referring now to FIG. 9, a process for evaluating a post-fracture wellbore, and upscaling the single-well model to provide field level analysis is shown according to a preferred embodiment. Process 900 is a more detailed description of step 540 of FIG. 5.

Process 900 begins by performing data collection and uncertainty analysis of the post-fracture well (step 910). Similar to steps 710-750 of FIG. 7 as described above, a flow profile of the well is developed. The sandface is conditioned to prepare the well for hydrocarbon flow. The preparations include removing damage from within the wellbore, and drying the formation.

During the fracturing process, the porous nature of the formation can be compromised, or blocked, preventing reservoir fluids from properly flowing into the wellbore. Damage to the wellbore is generally caused by the invasion of drilling mud, drill cuttings, other particulates or even dissolved particulates in the reservoir water. To obtain accurate information regarding the possible production characteristics of the reservoir, the damage to the wellbore must be removed.

Removing damage from the wellbore comprises various mechanisms for unblocking the pores of the formation adjacent to the wellbore. By way of non-limiting example, damage removal can be accomplished by drying the formation to evaporate water blockages, acid-etching the surface of the wellbore, and using ultrasonic techniques to disperse any blockages.

Coiled tube jetting with an alcohol nitrogen mixture can again be performed. The formation is dried to alleviate any potential water blocks around the wellbore. A coiled tubing jet is typically lowered into the wellbore. A fluid, gas, or mixture thereof is then jetted into the wellbore. The fluid/gas mixture generally selected should be readily miscible with water, and have a low heat of vaporization, and have a low humidity or water partial. These properties ensure that the fluid will readily dissolve any water blockages, and vaporize any water which is contacted. The fluid can be a nitrogen/alcohol mixture. The wellbore is then jetted with the fluid mixture.

The wellbore is shut prior to flow to allow alcohol absorption. The wellbore is then sealed, and the mixture is allowed to absorb into the rock matrix surrounding the wellbore. The low vapor pressure of the mixture will evaporate water blockages within the wellbore, allowing reservoir fluids to flow into the wellbore more freely. After a period of time allowing pressure within the wellbore to stabilize, the well is then opened. A velocity string inside a drill string testing tool is inserted into the wellbore to a mid-formation depth.

The well is then allowed to flow with the iCOIL in place, again acting as a velocity string. Then another temperature reading is taken with the fiber optic cable. By comparing the pre-fracture flow from the well to the flow profile obtained post-fracture, a determination can be made as to the amount of flow directly attributable to the fracture (or other stimulation/treatment) that was applied to the well. Once that is cleaned up, pressure is built up again. There could be a DST< or a pressure determination within the iCOIL. (iCOIL is an "information coil" that is a real time information/imaging device, that determines real time temperature and pressure.)

Process 900 then provides a predictive forecast of the drainage pattern (step 920). Based on the production predictions of the prefractured wellbores gathered from information based forecasts prior to fracturing, the post-fracture flow velocity can be superimposed on the prefracture reservoir models. By superimposing the post-fracture flow velocity on the prefracture reservoir models, a clear picture of the predicted post-fracture productivity of the well, and the resulting drainage pattern in the field, can be established.

In one illustrative embodiment, a fracture of a certain length is detected as being generated from the hydraulic reservoir cracking. Based on the extensiveness of the crack, an estimation can be made of the area within the field that is being drained which contributes to the increased hydrocarbon production in the post-fracture flow profile.

Process 900 continues by upscaling the single well model to a number of wells needed for structure based on economic parameters set by the client and the field (step 930).

In one illustrative embodiment, a fracture of a certain length is detected as being generated from the hydraulic reservoir cracking. Based on the extensiveness of the crack, an estimation can be made of the area within the field that is being drained which contributes to the increased hydrocarbon production in the post-fracture flow profile.

If drainage throughout the field is assumed to be constant, and the size of the area that will be drained is known, process 900 can upscale the single well model and determine an approximation of how many wells are needed to be placed into the field in order to drain the field over a certain time period.

Process 900 then provides a simple economic and cash flow analysis (step 940), with the process terminating thereafter. The economic and cash flow analysis is similar to the analysis of process step 650 of FIG. 6, except that now the probability distribution shifts "to the right" based on the increased production of the cracked/perforated wells. Process 900 can perform a probability distribution based on the communicative production. The p10, p50, and p90 values are increased from their pre-fracture values based on the increased production of the cracked/perforated wells.

Process 900 performs a productivity forecast for the structure composing compilation options. Operating costs are considered. Process 900 runs an analysis of what configuration of pumps within the field is going to provide the highest net-present value (NPV) based on each of the p10, p50, and p90 cases to provide an indication of the basic cash flow. From this cash flow consideration, process 900 identifies the number of wells needed to drain the field and the various times required to do so, based on the p10, p50, and p90 cases. The economic return can then be calculated, since the time of investment is known. From this data, a field development plan can be generated.

Thus, the illustrative embodiments describe a "lite" field development plan. This is a coarse analysis that can be done within a manageable amount of time. Often during field development, companies will try and develop a full three dimensional numerical model of the entire field and then try to guess how many wells to put into the field. The present model develops a model for a single well (or a plurality of exploratory wells), and then extrapolates the data for that one well to the entire field.

The presently described embodiments describe a new method for assessing the probability of production at a site. The process comprises the four steps of: 1) Data Collection and Uncertainty Analysis; 2) Wellsite Preparation; 3) Treatment Selection/Job Execution; and 4) Evaluation and Upscaling to Field Level.

Although the foregoing is provided for purposes of illustrating, explaining and describing certain embodiments of the invention in particular detail, modifications and adaptations to the described methods, systems and other embodiments will be apparent to those skilled in the art and may be made without departing from the scope or spirit of the invention.

What is claimed is:

1. A method for assessing the probability of production at a wellsite within a field, the method comprising:

collecting data from an exploratory well and performing an uncertainty analysis on the data;

preparing the exploratory well for flow by performing at least one remedial measure on a wellbore of the exploratory well;

identifying an initial flow rate of hydrocarbons from the wellbore of the exploratory well;

performing a selected completion method on the exploratory well;

determining a second flow rate of hydrocarbons from the wellbore to identify an increased production amount due to the remedial measure;

responsive to identifying the increased production amount due to the remedial measure, evaluating results for the wellsite using a single well model; and upscaling the results to a field level.

2. The method for assessing the probability of production at a wellsite within a field of claim 1, wherein the step of collecting data from an exploratory well, and performing an uncertainty analysis on the data further comprises at least one step selected from the group including:

identifying information from well logs, mud logs, and drilling flowback taken from the exploratory well; and characterizing a near wellbore fracture network as either a single porosity zone or a dual porosity zone.

3. The method for assessing the probability of production at a wellsite within a field of claim 2, wherein the step of characterizing the near wellbore fracture network further comprises seismically characterizing the near wellbore fracture network by identifying at least one of a seismic velocity, a seismic shear, and a seismic impedance.

4. The method for assessing the probability of production at a wellsite within a field of claim 1, wherein the step of collecting data from an exploratory well, and performing an uncertainty analysis on the data further comprises developing the single well model to incorporate the data.

5. The method for assessing the probability of production at a wellsite within a field of claim 4, wherein the step of developing the single well model further comprises at least one step selected from the group including:

incorporating information from well logs, mud logs, and drilling flowback taken from the exploratory well, as well as measurements taken away from the wellbore;

excluding effects from wells within the field that are not effects from the exploratory well; and developing a continuous wellbore model from the single well model, wherein the continuous wellbore model gives a point-by-point assessment of the parameters in the exploratory well such that various layers and potential reservoirs within the wellsite can be identified.

6. The method for assessing the probability of production at a wellsite within a field of claim 1, wherein the step of collecting data from an exploratory well, and performing an uncertainty analysis on the data further comprises performing an uncertainty analysis based on variance to determine probability ranges.

7. The method for assessing the probability of production at a wellsite within a field of claim 6, wherein the step of performing an uncertainty analysis based on variance to determine probability ranges further comprises at least one step selected from the group including:

for each lithology within the exploratory well, identifying a range of porosities, identifying a range of saturations within the exploratory well, and identifying a range of permeability;

identifying a statistical probability distribution for each layer within the exploratory well; and performing a Monte Carlo analysis on the statistical probability distribution to obtain a probability risk analysis for an overall probability of production from the wellsite, wherein the probability risk analysis includes a best case scenario, an expected scenario, and a worst case scenario.

8. The method for assessing the probability of production at a wellsite within a field of claim 1, wherein the step of collecting data from an exploratory well, and performing an uncertainty analysis on the data further comprises performing a productivity forecasting for structure composing compilation options.

9. The method for assessing the probability of production at a wellsite within a field of claim 8, wherein the step of performing the productivity forecasting for structure composing compilation options further comprises at least one step selected from the group including:

identifying how many production wells need to be implemented in the field in order to make the field economically viable;

identifying a most likely scenario and a most likely number of wells needed to meet an economic hurdle based on an expected scenario; and identifying a basic cash flow from a highest net-present value based a best case scenario, the expected scenario, and a worst case scenario.

10. The method for assessing the probability of production at a wellsite within a field of claim 1, wherein the step of preparing the exploratory well for flow by performing at least one remedial measure on the wellbore of the exploratory well further comprises at least one step selected from the group including:

conditioning the sandface of the exploratory well to prepare the exploratory well for hydrocarbon flow, wherein the conditioning step includes at least one step selected from the group including drying the formation to evaporate water blockages, acid-etching the sandface of the wellbore, and using ultrasonic techniques to disperse any blockages;

coiled tube jetting the exploratory well with an alcohol nitrogen mixture to dissolve any water blockages and to vaporize any water that is contacted; and shutting in the wellbore prior to flow to allow absorption of the alcohol nitrogen mixture.

11. The method for assessing the probability of production at a wellsite within a field of claim 1, wherein the step of identifying an initial flow rate of hydrocarbons from a wellbore of the exploratory well further comprises at least one step selected from the group including:

inserting a velocity tube within a drill string texting tool to overcome liquid loading effects within the exploratory well;

isolating a hydrocarbon layer of the exploratory well with the drill string texting tool in order to identify at least one of a productive capacity, a pressure, a permeability or extent of the hydrocarbon layer;

identifying temperature profile at a constant reservoir pressure of the exploratory well by identifying a temperature gradient in a fiber optic cable, and inferring the flow from the exploratory well based on the temperature profile; and identifying whether the hydrocarbon layer is producing emissions.

12. The method for assessing the probability of production at a wellsite within a field of claim 1, wherein the step of performing a selected completion method on the exploratory well further comprises at least one step selected from the group including:

selecting a perforation strategy, wherein the perforation strategy is either an underbalanced perforation strategy or an overbalanced perforation strategy;

performing a diagnostic injection procedure of the exploratory well to identify natural stress fractures in the near wellbore area, and to evaluate a stress environment and a permeability environment in the near wellbore area;

identifying a fluid type, proppant type, and pump selection for formation cracking to maximize generation from a hydrocarbon layer and pay coverage of the wellsite; and identifying a post fracture profile by performing a coiled tubing cleanout and an annular flowback analysis.

13. The method for assessing the probability of production at a wellsite within a field of claim 1, wherein the step of evaluating results for the wellsite using a single well model further comprises:

performing post-fracture data collection and post-fracture uncertainty analysis of the exploratory well; and determining a predictive forecast of a post-fracture drainage pattern of the exploratory well.

14. The method for assessing the probability of production at a wellsite within a field of claim 13, wherein the step of determining a predictive forecast of a post-fracture drainage pattern of the exploratory well further comprises:

determining a predictive forecast of a post-fracture drainage pattern of the exploratory well based on a fracture length is detected as being generated from a hydraulic reservoir cracking and estimating an area within the field that is being drained which contributes to the increased hydrocarbon production.

15. The method for assessing the probability of production at a wellsite within a field of claim 14, wherein the step of upscaling the results to the field level further comprises:

responsive to determining a predictive forecast of a post-fracture drainage pattern of the exploratory well based on a fracture length is detected as being generated from a hydraulic reservoir cracking and estimating an area within the field that is being drained which contributes to the increased hydrocarbon production, identifying a number of wells needed to be placed in order to drain the field over a certain period of time.

16. A method for controlling a drilling operation for an oilfield, the oilfield having a wellsite with a drilling tool advanced into a subterranean formation with geological structures and reservoirs therein, comprising:

collecting data from an exploratory well and performing an uncertainty analysis on the data;

preparing the exploratory well for flow by performing at least one remedial measure on a wellbore of the exploratory well;

identifying an initial flow rate of hydrocarbons from the wellbore of the exploratory well;

performing a selected completion method on the exploratory well;

determining a second flow rate of hydrocarbons from the wellbore to identify an increased production amount due to the remedial measure;

responsive to identifying the increased production amount due to the remedial measure, evaluating results for the wellsite using a single well model; and upscaling the results to a field level.

17. The method for controlling a drilling operation for an oilfield of claim 16, wherein the step of collecting data from an exploratory well, and performing an uncertainty analysis on the data further comprises at least one step selected from the group including:

identifying information from well logs, mud logs, and drilling flowback taken from the exploratory well; and characterizing a near wellbore fracture network as either a single porosity zone or a dual porosity zone.

18. The method for controlling a drilling operation for an oilfield of claim 17, wherein the step of characterizing the near wellbore fracture network further comprises seismically characterizing the near wellbore fracture network by identifying at least one of a seismic velocity, a seismic shear, and a seismic impedance.

19. The method for controlling a drilling operation for an oilfield of claim 16, wherein the step of collecting data from an exploratory well, and performing an uncertainty analysis on the data further comprises developing the single well model to incorporate the data.

20. The method for controlling a drilling operation for an oilfield of claim 19, wherein the step of developing the single well model further comprises at least one step selected from the group including:

incorporating information from well logs, mud logs, and drilling flowback taken from the exploratory well, as well as measurements taken away from the wellbore;

excluding effects from wells within the field that are not effects from the exploratory well; and developing a continuous wellbore model from the single well model, wherein the continuous wellbore model gives a point-by-point assessment of the parameters in the exploratory well such that various layers and potential reservoirs within the wellsite can be identified.

* * * * *